US006523981B2

(12) United States Patent
Wu

(10) Patent No.: US 6,523,981 B2
(45) Date of Patent: Feb. 25, 2003

(54) STRUCTURE RAPID ASSEMBLY/ DISASSEMBLY LAMP SHADE

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/887,425

(22) Filed: Jun. 25, 2001

(65) Prior Publication Data

US 2002/0196631 A1 Dec. 26, 2002

(51) Int. Cl.[7] ..... F21V 17/00; F21V 1/06
(52) U.S. Cl. ..... 362/352; 362/414; 362/358
(58) Field of Search ..... 362/410, 414, 362/351, 352, 358

(56) References Cited

U.S. PATENT DOCUMENTS 6,315,434 B1 * 11/2001 Long ..... 362/352
6,386,739 B1 * 5/2002 Wu ..... 362/352
2001/0036079 A1 * 11/2001 Huang ..... 362/352

* cited by examiner

*Primary Examiner*—Thomas M. Sember
(74) *Attorney, Agent, or Firm*—Troxell Law Office PLLC

(57) ABSTRACT

An improved rapid assembly/disassembly lamp shade including a top ring, a bottom ring of larger circumference than the top ring, and frame members propped between the top ring and the bottom ring. The top horizontally bowed rod section of each frame member has a laterally projecting tenon such that after the frame members are assembled, the tenons maintain the top horizontally bowed rod sections against the bottom edge of the top ring. Fastening sections having insertive holes are punch molded at bottom ends of the frame members. The fastening sections are placed through the open end of the bottom ring and coupled onto the bottom ring. A series of sequentially arrayed locating slots disposed on the bottom ring in alignment with frame member positions restrict the movement of the frame members.

2 Claims, 7 Drawing Sheets

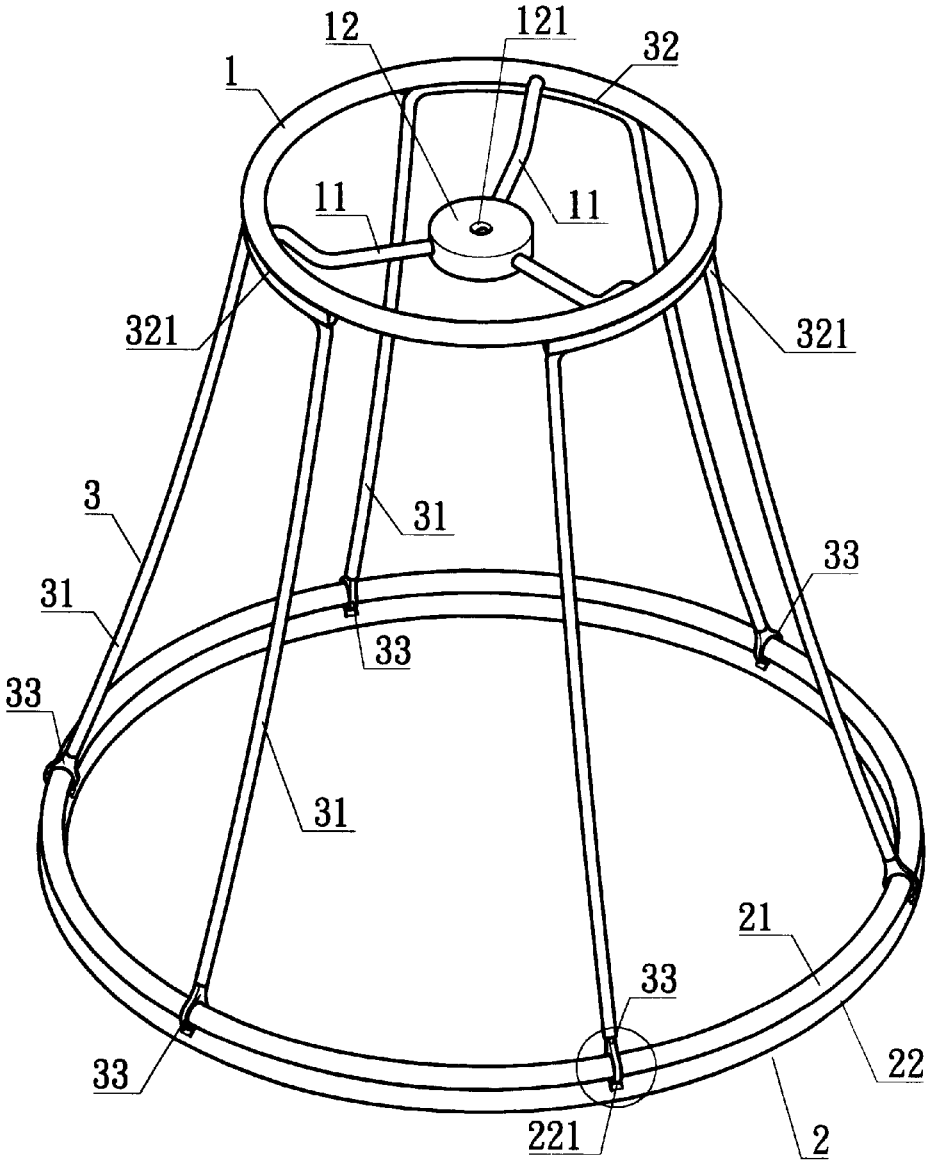
FIG2
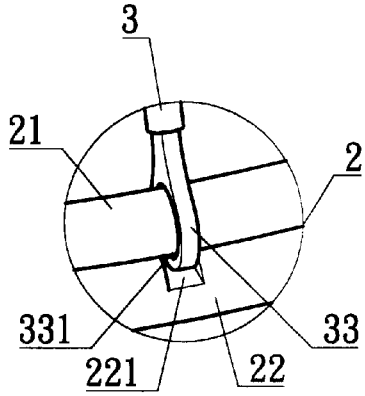
FIG2-A

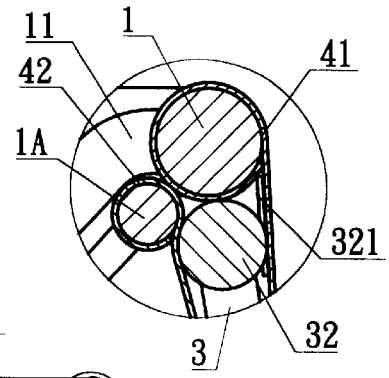
FIG6-A
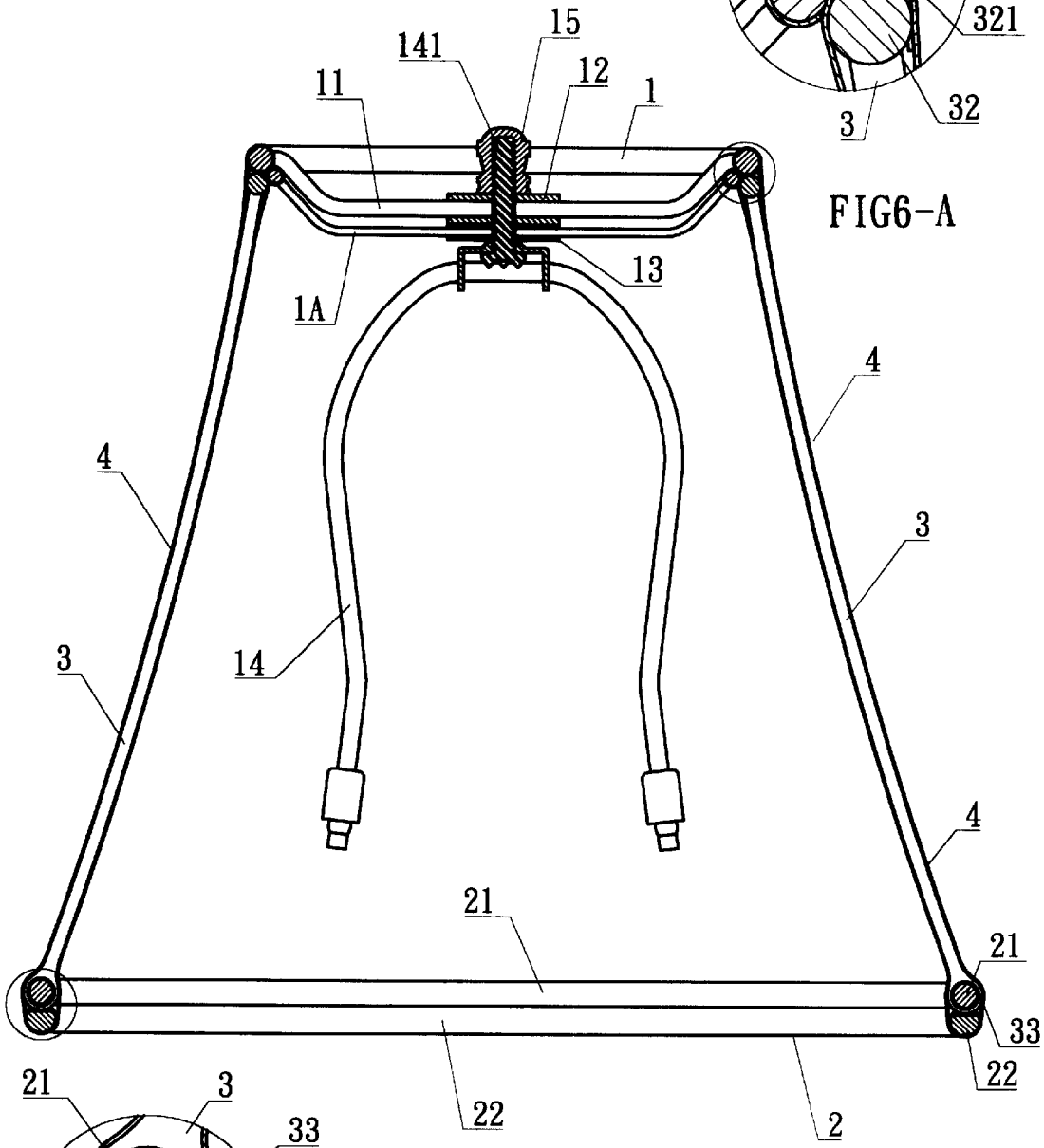
FIG6
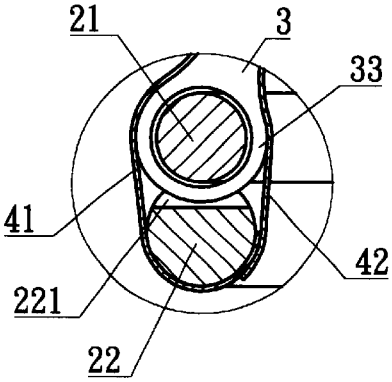
FIG6-B

STRUCTURE RAPID ASSEMBLY/ DISASSEMBLY LAMP SHADE

BACKGROUND OF THE INVENTION

1) Field of the Invention

The invention herein relates to an improved structure rapid assembly/disassembly lamp shade comprised of a top ring, a bottom ring, and frame members propped between the top and the bottom ring; the top horizontally bowed rod section of each frame member has a laterally projecting tenon capable of maintaining the top horizontally bowed rod sections against the bottom edge of the top ring; fastening sections capable of being coupled onto the bottom ring are continuously punch molded at the bottom ends of the frame members; and a series of sequentially arrayed locating slots are disposed on the bottom ring in alignment with the frame member positions to restrict the movement of the frame members; as such, when the present invention is packaged, the frame members are first whorled down into a flat arrangement such that the lamp shade occupies the smallest physical assembly space to thereby effectively reduce shipping costs.

2) Description of the Prior Art

A conventional lamp shade 5 typically has frame members permanently installed between the top ring and the bottom ring to form a lamp shade structure; the structural shortcomings of which are listed below (as indicated in FIG. 7):

Since the conventional lamp shade 5 is a structural entity of an unyielding shape, when it is packaged in a carton, it cannot be forcefully diminished in size, occupies considerable space, and no reduction in excessive volumetric storage area is possible, which leads to a proportional increase in product shipping costs.

SUMMARY OF THE INVENTION

The primary objective of the invention herein is to provide an improved structure rapid assembly/disassembly lamp shade, wherein the top horizontally bowed rod section of each frame member has a laterally projecting tenon such that after the frame members are assembled, the tenons maintain the top horizontally bowed rod sections against the bottom edge of the top ring; fastening sections having insertive holes are continuously punch molded at the bottom ends of the frame members and, furthermore, the fastening sections are placed through the open end of the bottom ring and coupled onto the bottom ring; a series of sequentially arrayed locating slots are disposed on the bottom ring in alignment with the frame member positions to restrict the movement of the frame members; the lamp shade fabric is attached to the outermost sides and envelops the top and bottom ring as well as the frame members; as such, when the lamp shade of the present invention is packaged, the frame members are first whorled down into a flat arrangement to occupy the smallest physical assembly space, thereby facilitating ease of assembly and, furthermore, affording minimized storage and shipping volumetric dimensions that effectively reduces shipping costs.

BRIEF DESCRIPTION OF THE DRAWINGS

FIG. 2 is an isometric drawing of the invention herein.

FIG. 2–A is a magnified view of the bottom ring and the frame member sections.

FIG. 6 is a cross-sectional drawing of the lamp shade of the invention herein.

FIG. 6–A is a magnified, partial cross-sectional drawing of the lamp shade.

FIG. 6–B is a magnified, partial cross-sectional magnified view of the lamp shade.

DETAILED DESCRIPTION OF THE INVENTION

Figure 1:
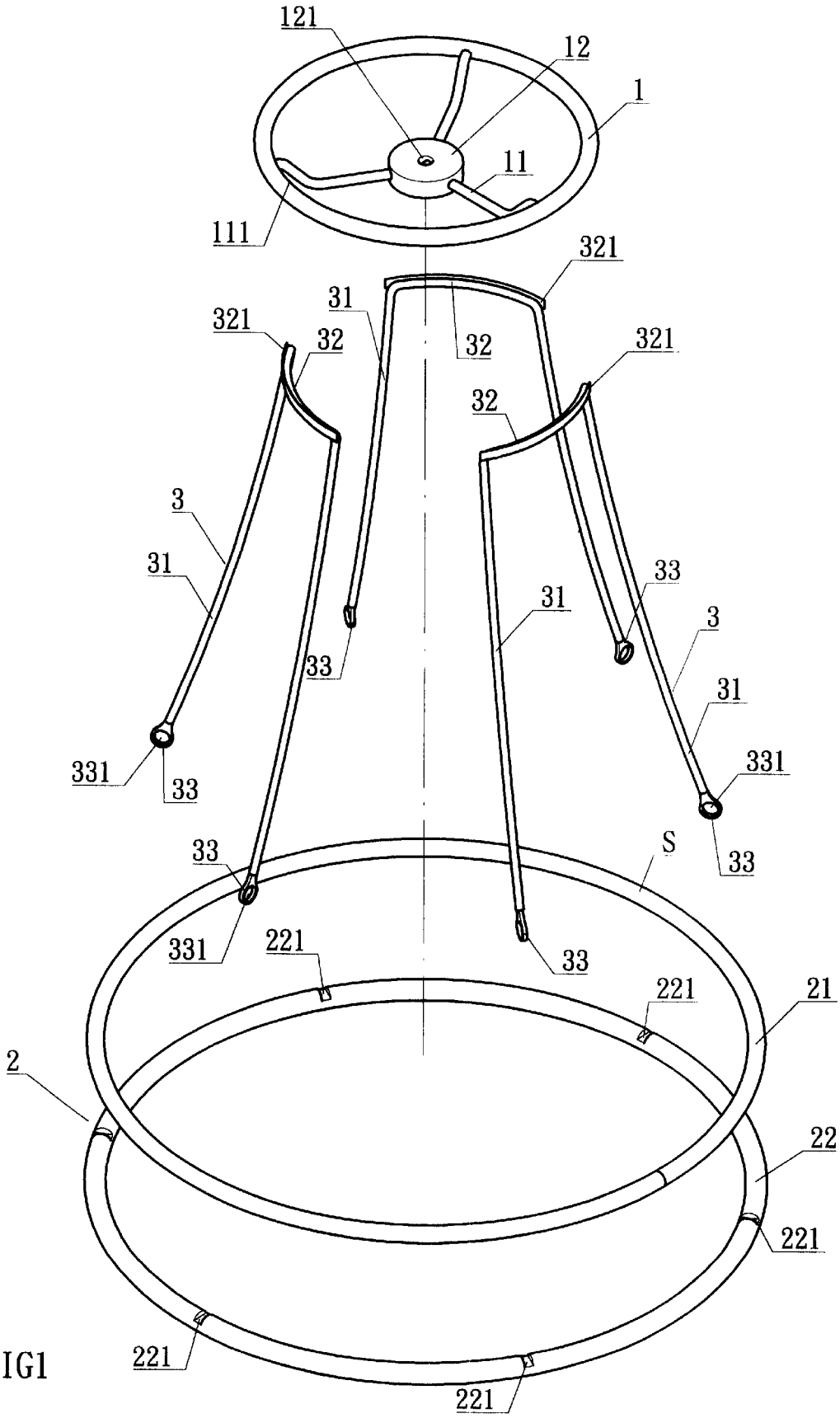
FIG. 1 is an exploded drawing of the invention herein.

Referring to FIG. 1 and FIG. 2, the invention herein is comprised of a top ring 1 at the uppermost end of a lamp shade 4, a bottom ring 2 of larger circumference than the top ring 1, and frame members 3 propped between the top ring 1 and the bottom ring 2, of which:

The said top ring 1 is of annular metal construction and, furthermore, is situated against a cylindrical lamp pipe structure, with the top ring 1 having support rods 11 extending from the center towards its circumference and, in addition, the support rods 11 intersect centrally to a middle ring 12 having a mounting hole 121; and an inclosing space 111 is formed by the upward bending of the support rods 11 at the circumferential edge.

The said bottom ring 2 consists of a suitably positioned upper ring 21 having an open end S and a lower ring 21 attached to the underside of the upper ring 22, wherein the open end S of the said upper ring 21 provides for the insertion of the frame members 3 and the welding of their anchoring sections 31 within the open end S of the upper ring 21; the said lower ring 22 is then aligned with the upper ring 21 at the frame member 3 positions and then a series of sequentially arrayed locating slots 221 is disposed to provide for the attachment of the upper and lower rings 21 and 22, following which the said locating slots 221 restricts the movement of the frame members 3.

Each said frame member 3 consists of a left and a right vertically bowed rod section 31 and a top horizontally bowed rod section 32 and, furthermore, the top horizontally bowed rod section 32 of each frame member 3 has a laterally projecting tenon 321 such that after the frame members 3 are assembled, the tenons 321 maintain the top horizontally bowed rod sections 32 against the bottom edge of the top ring 1 to thereby prevent the dislodging of the frame members 3 when subjected to impact; flat-shaped fastening sections 33 are continuously punch molded at the bottom ends of the frame members 3 and, furthermore, an insertive hole 331 is formed through the center of each fastening section 32 to provide for slipping them onto the bottom ring 2.

Figure 3:
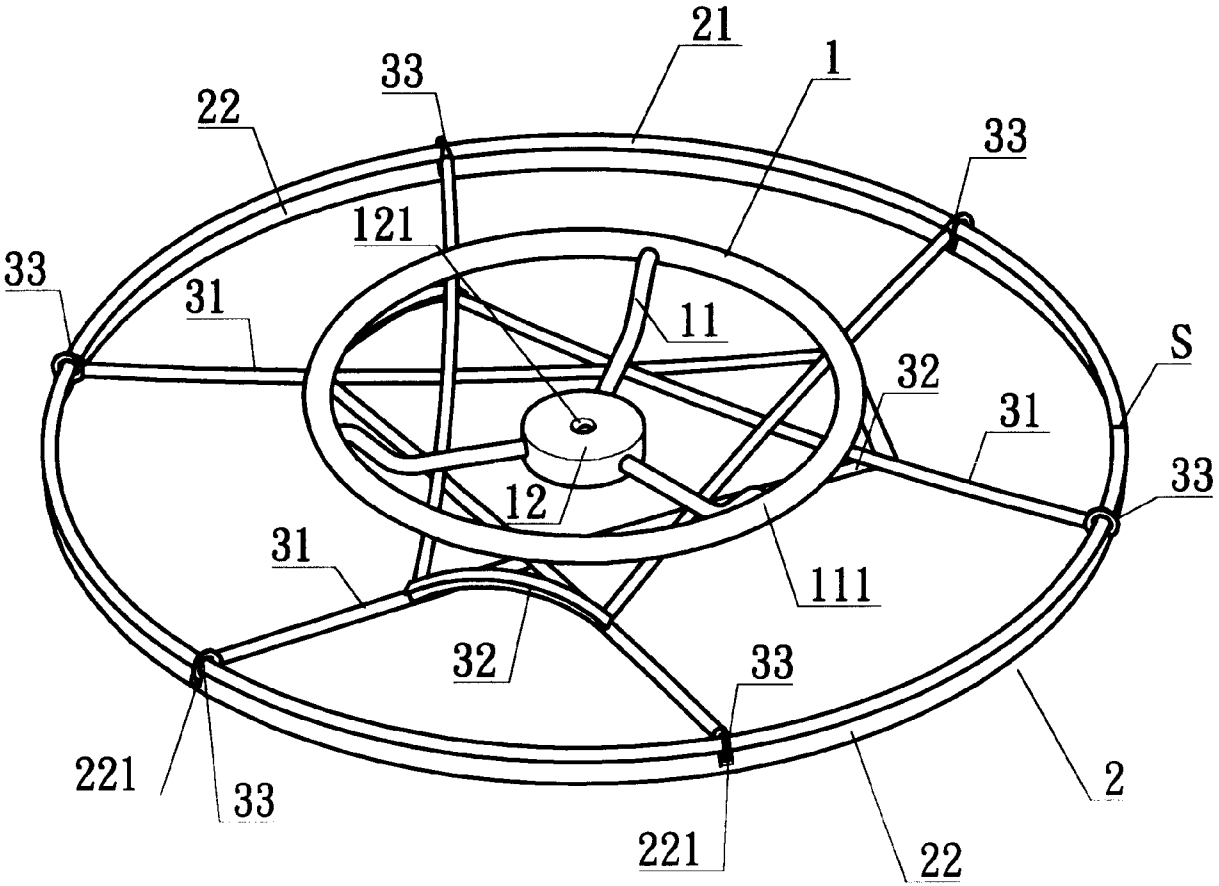
FIG. 3 is an isometric drawing of the invention herein is the folded state.

As indicated in FIG. 3, with the fastening sections 33 of the said frame members 3 coupled onto the bottom ring 2, the frame members 3 are capable of being whorled over the bottom ring 2; as such, this facilitates lamp shade 4 packaging since the frame members 3 can be twirled down beforehand into a flat arrangement; as such, when the lamp shade 4 of the present invention is packaged in cartons, the frame members 3 are first gyrated down into a flat arrangement to occupy the smallest physical space, thereby facilitating ease of assembly and, furthermore, affording minimized volumetric dimensions that effectively reduces shipping costs.

Figure 4:
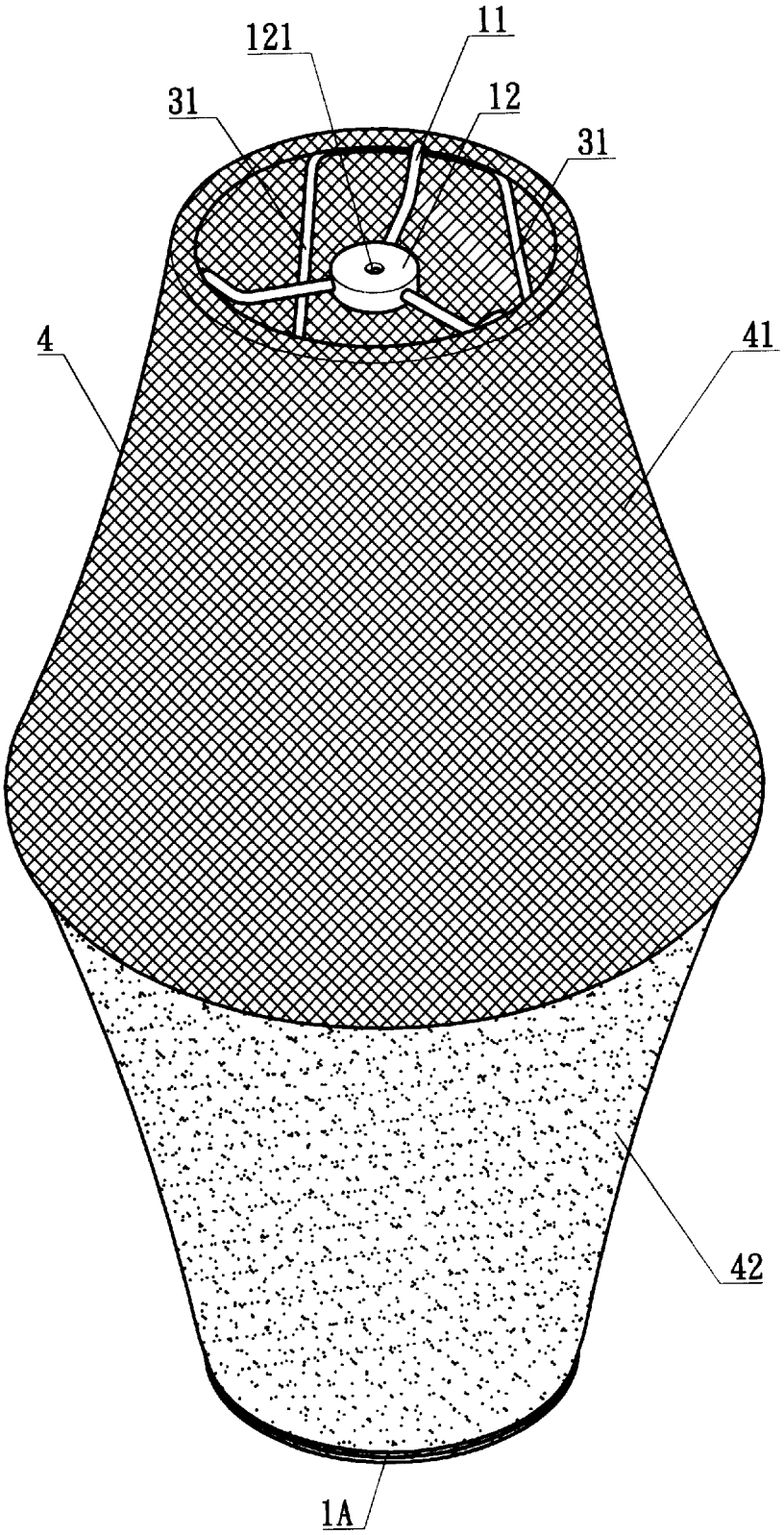
FIG. 4 is an isometric drawing of the inner and outer layers of the lamp shade.
Figure 5:
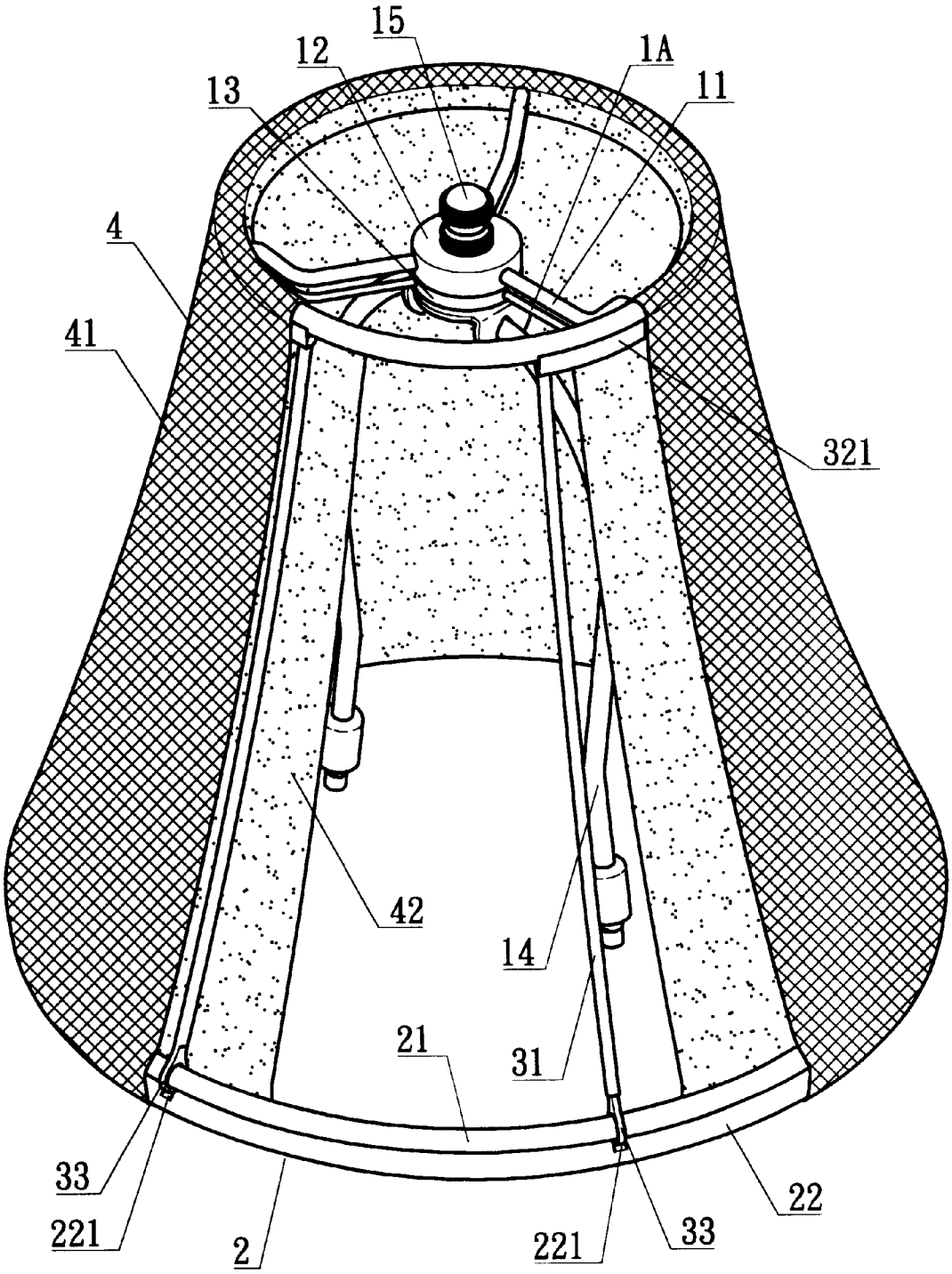
FIG. 5 is an isometric cross-sectional drawing of the erected lamp shade.
Figure 7:
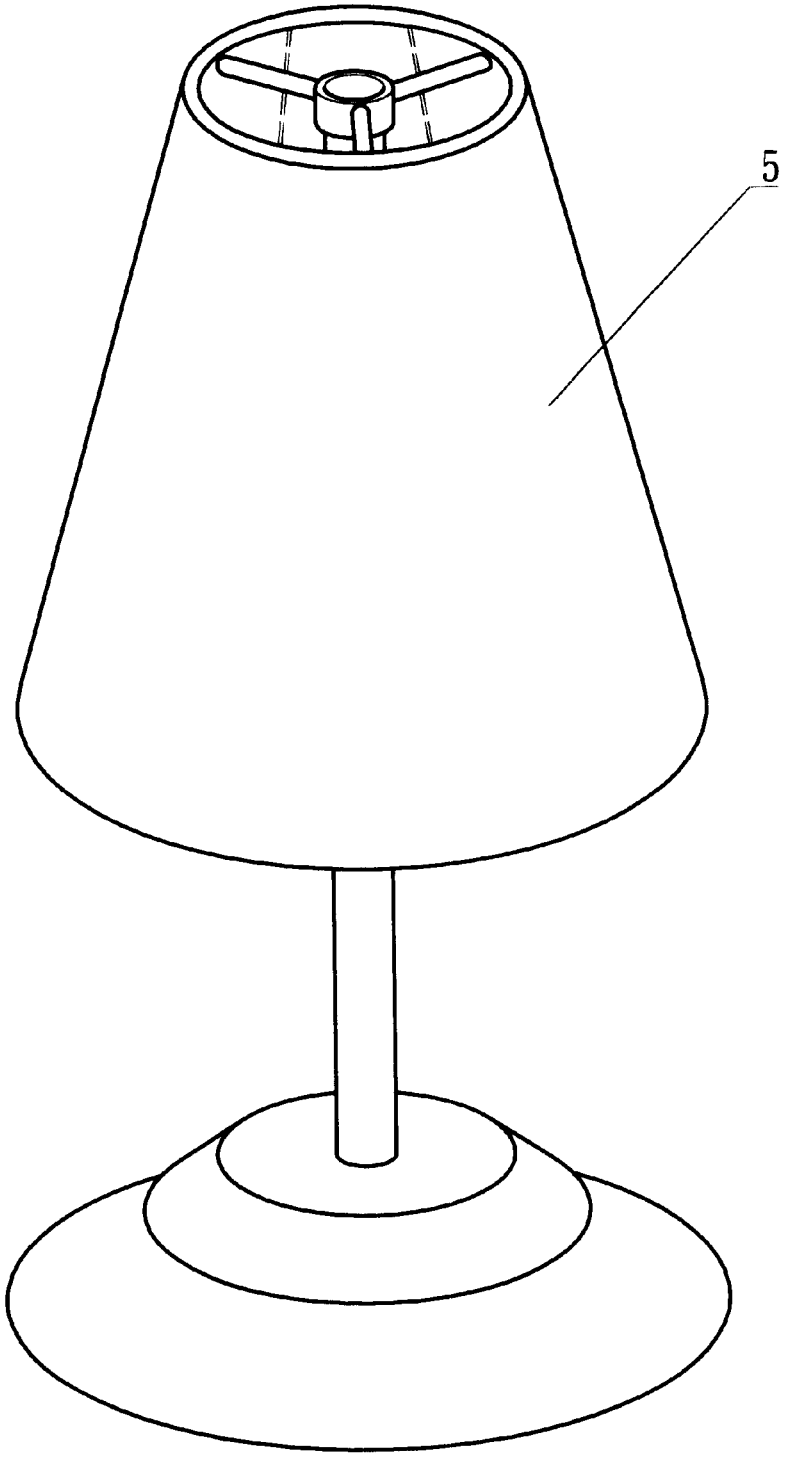
FIG7 PRIOR ART
FIG. 7 is an isometric drawing of a conventional lamp shade.

As indicated in FIG. 4, FIG. 5, FIG. 6, FIG. 6–A, and FIG. 6–B, after the assembly of the said lamp shade 4 framework is completed, the exterior periphery of the top ring 1 and the bottom ring 2 are covered with a fabric material lamp shade 4, wherein the exterior fabric surface layer 41 of the said lamp shade 4 is first tightly fitted around the outer periphery of the top ring 1 and the bottom ring 2; the interior fabric surface layer 42 is then attached onto the bottom ring 2 and, furthermore, the other end of the interior fabric surface layer 42 is attached to an inner top ring 1A situated against the lower extent of the top ring 1 such the interior fabric surface layer 42 is positioned upward between the inner top ring 1A and the bottom end of the top ring 1 (as shown in FIG. 4); the said inner top ring 1A has formed centrally from its circumferential edge a middle ring 13 with a mounting hole that provides for the insertion of the top end of a threaded stud 141 of a light bulb frame 14 upward into the lamp shade 4 and through the respective mounting holes of the inner top ring 1A and the top ring 1 to which a nut 15 is then fastened at the exterior section of the lamp shade 4 to secure the interior fabric surface layer 42 to the inside of the frame members 3, the exterior and interior fabric surface layers 41 and 42 thereby forming an ensconcing structural arrangement in which the frame members 3 as well as the top and bottom rings 1 and 2 are enveloped such that frame members remain unexposed to effectively achieve an attractive appearance; as such, when the lamp shade 4 framework is folded, the lamp shade 4 collapses along with it to achieve a reduction in storage and shipping volumetric dimensions.

What is claimed is:

1. A rapid assembly/disassembly lamp shade comprising a top ring, a bottom ring of larger circumference than the top ring, frame members propped between the top ring and the bottom ring, and a fabric material around an exterior periphery of the top ring and the bottom ring, wherein the top ring has support rods extending from a center towards a circumference of the top ring, the support rods extending from a first middle ring having a first mounting hole, an inclosing space being formed by an upward bending of the support rods at the top ring;

the bottom ring includes an upper ring having an open end and a lower ring attached under the upper ring, the open end of the upper ring provides for the insertion of the frame members within the open end, the lower ring being aligned with the upper ring and including a plurality of sequentially arrayed locating slots to restrict movement of the frame members;

each frame member including a left and a right vertically bowed rod section and a top horizontally bowed rod section, the top horizontally bowed rod section of each frame member has a laterally projecting tenon whereby the tenons maintain the top horizontally bowed rod sections against a bottom edge of the top ring; and flat-shaped fastening sections are punch molded at bottom ends of the frame members with an insertive hole formed through a center of each fastening section to provide for slipping them onto the bottom ring; and the exterior fabric material is tightly fitted around exterior peripheries of the top ring and the bottom ring and includes an interior fabric surface layer attached to the bottom ring, a top end of the interior fabric surface layer is attached to an inner top ring situated against a lower extent of the top ring, the inner top ring has a second middle ring with a second mounting hole.

2. The rapid assembly/disassembly lamp shade as claimed in claim 1, the second middle ring and the second mounting hole are located centrally of the inner top ring and provide for insertion of an upper end of a threaded stud of a light bulb frame into the lamp shade and through the first mounting hole of the inner top ring to which a nut is fastened at an exterior section of the lamp shade to secure the interior fabric surface layer to an inside of the frame members, the exterior and interior fabric surface layers thereby forming an ensconcing structural arrangement to effectively achieve an attractive appearance.

* * * * *